US006233971B1

(12) United States Patent
Ohlund

(10) Patent No.: US 6,233,971 B1
(45) Date of Patent: May 22, 2001

(54) JEWELRY PIECE

(75) Inventor: Stephen K. Ohlund, San Luis Obispo, CA (US)

(73) Assignee: Calypso Worldwide Marketing, Inc., Nassau (BS)

( * ) Notice: Subject to any disclaimer, the term of this patent is extended or adjusted under 35 U.S.C. 154(b) by 0 days.

(21) Appl. No.: 09/229,728

(22) Filed: Jan. 13, 1999

Related U.S. Application Data

(63) Continuation-in-part of application No. 09/134,189, filed on Aug. 14, 1998, now Pat. No. 6,122,933.

(51) Int. Cl.[7] ..... A44C 5/00

(52) U.S. Cl. ..... 63/3; 63/3.1; 63/900; 362/104; 429/97; 439/805

(58) Field of Search ..... 63/3, 3.1, 33, 900, 63/29.2, 2 L, FOR 101; 362/104, 340; 429/97; 439/500, 805

(56) References Cited

U.S. PATENT DOCUMENTS

| | | | | |
|---|---|---|---|---|
| 2,615,227 | * | 10/1952 | Hornik | 63/900 X |
| 4,262,324 | * | 4/1981 | Murphy | 362/104 |
| 4,271,457 | * | 6/1981 | Martin | 362/104 |
| 4,309,743 | * | 1/1982 | Martin | 362/104 |
| 4,459,645 | * | 7/1984 | Glatter | 362/104 |
| 4,894,757 | * | 1/1990 | Frusha et al. | 362/104 |
| 5,099,659 | * | 3/1992 | Carranza et al. | 63/3 |
| 5,140,840 | * | 8/1992 | Miceli | 362/104 X |
| 5,367,891 | * | 11/1994 | Furuyama | 63/3 X |
| 5,477,433 | * | 12/1995 | Ohlund | 362/104 |
| 5,572,887 | * | 11/1996 | Geswelli | 63/3 |
| 5,653,530 | * | 8/1997 | Pittman | 362/307 |
| 5,722,260 | * | 3/1998 | Mangano | 63/3.1 |
| 5,806,346 | * | 9/1998 | Schlinger et al. | 63/900 X |
| 5,876,109 | * | 3/1999 | Scalco | 362/104 |
| 6,122,933 | * | 9/2000 | Ohlund | 63/3 |

* cited by examiner

*Primary Examiner*—Anthony Knight
*Assistant Examiner*—Andrea Chop
(74) *Attorney, Agent, or Firm*—Holland & Knight LLP

(57) ABSTRACT

A jewelry piece 10 includes a light transparent, ornamental element 20 and a light emitting diode 16 positioned near the ornamental element. A battery case 12 has a side wall 12*b* having a threaded opening 29 therein providing access to a battery being held within the battery case. A mechanical clasp 14 has an outwardly projecting threaded element 14*b* adapted to be received in the threaded opening 29. There is a first conductive wire 26 having one end connected to one terminal of the battery and another end connected to the diode 16 and a second conductive wire 30 having one end connected to the light source and another end having a clasp 14. The clasp 14, when partially inserted into the opening 29, completes a loop but does not contact the other terminal of the battery, preventing the diode 16 from being energized. When completely inserted into the opening 29, the clasp 14 makes contact with the other terminal of battery to energize the light source. A magnetic clasp 60 may be substituted for the mechanical clasp 14. It has a pair of magnets 62 and 64 which engage to close the clasp 60 and are manually separated to open this clasp.

15 Claims, 9 Drawing Sheets

10
12
14
26a
1b
1b
2a
2a
26
30
1c
33
30
31

14
26b
4
4
20
3
21
22
12b
3
26
12a 5b
6a
12d
12b
70
5b
12
86
60
6a
50
30
8
8
58

12d
70
86
12b
7
7
12d
60

JEWELRY PIECE

RELATED PATENT APPLICATIONS

This application is a continuation-in-part application of U.S. Ser. No. 09/134,189, entitled "Jewelry Piece," filed Aug. 14, 1998 now U.S. Pat. No. 6,122,933. This related application is incorporated herein by reference and made a part of this application.

BACKGROUND OF THE INVENTION

1. Field of the Invention

This invention relates to an illuminated jewelry piece and, in particular, to one which the user may, by adjusting the position of a clasp, turn the illumination on and off.

2. Background Discussion

Illuminated jewelry pieces are well known and the inventor has described such an illuminated jewelry piece in his U.S. Pat. No. 5,477,433. As disclosed on this patent, the jewelry piece is illuminated intermittently. It would be desirable to provide an inexpensive, lightweight jewelry piece that allows the wearer to connect and disconnect the jewelry piece, and by a simple movement or repositioning of a clasp, cause the piece to be illuminated or have the illumination discontinued. This is especially desirable when the jewelry piece is a pendant or necklace.

SUMMARY OF THE INVENTION

It is the objective of this invention to provide a light weight, illuminated jewelry piece which, by adjusting a clasp, turns the illumination on and off.

The jewelry piece of this invention includes an ornamental element having pair connector members extending outward therefrom. These connector members are wrapped around a part of the body of a user, for example, the user's neck, wrist, ankle, etc. Each connector member has a free end, and these ends are attached and detached by a clasp member. One free end has a battery case connected to it and the other free end attaches to the battery case by means of either a mechanical or magnetic clasp member. An electrical circuit, including the connector members which are conductive, or include conductive members such as wires, is energized by a battery in the battery case to provide illumination for the ornamental element. The clasp member is manually moveable between a first position where the free ends are connected together and the electrical circuit is energized and a second position where the free ends are connected and the electrical circuit is de-energized. The clasp member may be disconnected to separate the free ends allowing the jewelry piece to be detached from the body of the user.

This invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENTS," one will understand how the features of this invention provide its benefits, which include, but are not limited to, an inexpensive to manufacture jewelry piece which is easy to use and manufacture, and provides a way for the ornamental element to be illuminate or not while the jewelry piece is being worn. In one embodiment, the ornamental element is illuminated or the illumination discontinued without detaching the jewelry piece by simply rotating the clasp member. In another embodiment, the ornamental element is illuminated with the clasp member closed and in one position. The illumination of the ornamental element is discontinued by opening the clasp member and repositioning it in another closed position that does not energize the electrical circuit.

The first feature of the jewelry piece of this invention is that it includes a light transparent, ornamental element positioned near a light source, such as a light emitting diode having a pair of electrodes. The light source is connected in the electrical circuit which is powered by a battery (an assembly of a number of batteries is considered a single battery since the assembly acts as one unit), having first and second terminals, one positive the other negative as is conventional. The battery is retained in the case which has an opening therein providing access to the first terminal of the battery. Preferably, the battery case is adapted to removable hold the battery, and this battery case has a threaded opening therein. Preferably, the light source is seated in an opaque housing. This housing has only a single light transmitting window which allows light from the light source to be transmitted outward.

The second feature is that the connector members comprise a pair of flexible, conductive wires for electrically connecting the light source to the battery in the case. A first conductive wire has one end connected to the second terminal of the battery and another end connected to the light source, and a second conductive wire has one end connected to the light source and another end having a unique, mechanical clasp thereon enabling the illumination to be turned on and off without disconnecting the mechanical clasp.

The third feature of this invention is the mechanical clasp. When partially inserted into the opening in the case, the clasp completes a loop around, for example, the neck of the wearer but does not contact the first terminal of the battery, preventing the light source from being energized. When completely inserted into the opening, the clasp makes contact with the first terminal of the battery to energize the light source. The second wire terminates in a conductive pin which passes through a passageway in the clasp, so that the clasp may be manually rotated relative to the pin and second wire. The clasp has a body with a threaded open end, a passageway extending through the body between the threaded end and another end. It is this threaded, open end of the clasp which is adapted to be received in the threaded opening in the battery case. When the clasp is so threaded into this threaded opening, the pin makes contact with the battery to complete a circuit and energize the light source.

The fourth feature is a magnetic clasp which may be used in place of the mechanical clasp. The magnetic clasp includes one magnetic element on the case which makes electrical contact with a battery in the case. Preferably, this one magnetic element has a spring biased contact member which insures engagement with the battery in the case. Another magnetic element is attached to a free end of one of the connector members. When the two magnetic elements engage when the user brings them into contact with each other, the electrical circuit is completed to illuminate the ornamental element.

The fifth feature is that the battery case has a second magnetic element attach to it which is electrically isolated from a battery placed in the case. This enables the magnetic clasp to be connected to this second magnetic element without energizing the electrical circuit.

DESCRIPTION OF THE DRAWING

The preferred embodiments of this invention, illustrating all its features, will now be discussed in detail. These embodiments depict the novel and non-obvious jewelry piece of this invention as shown in the accompanying drawing, which is for illustrative purposes only. This drawing includes the following figures (FIGS.), with like numerals indicating like parts.

DETAILED DESCRIPTION OF THE PREFERRED EMBODIMENTS

First Embodiment

Figures 1A, 1B, 1C:
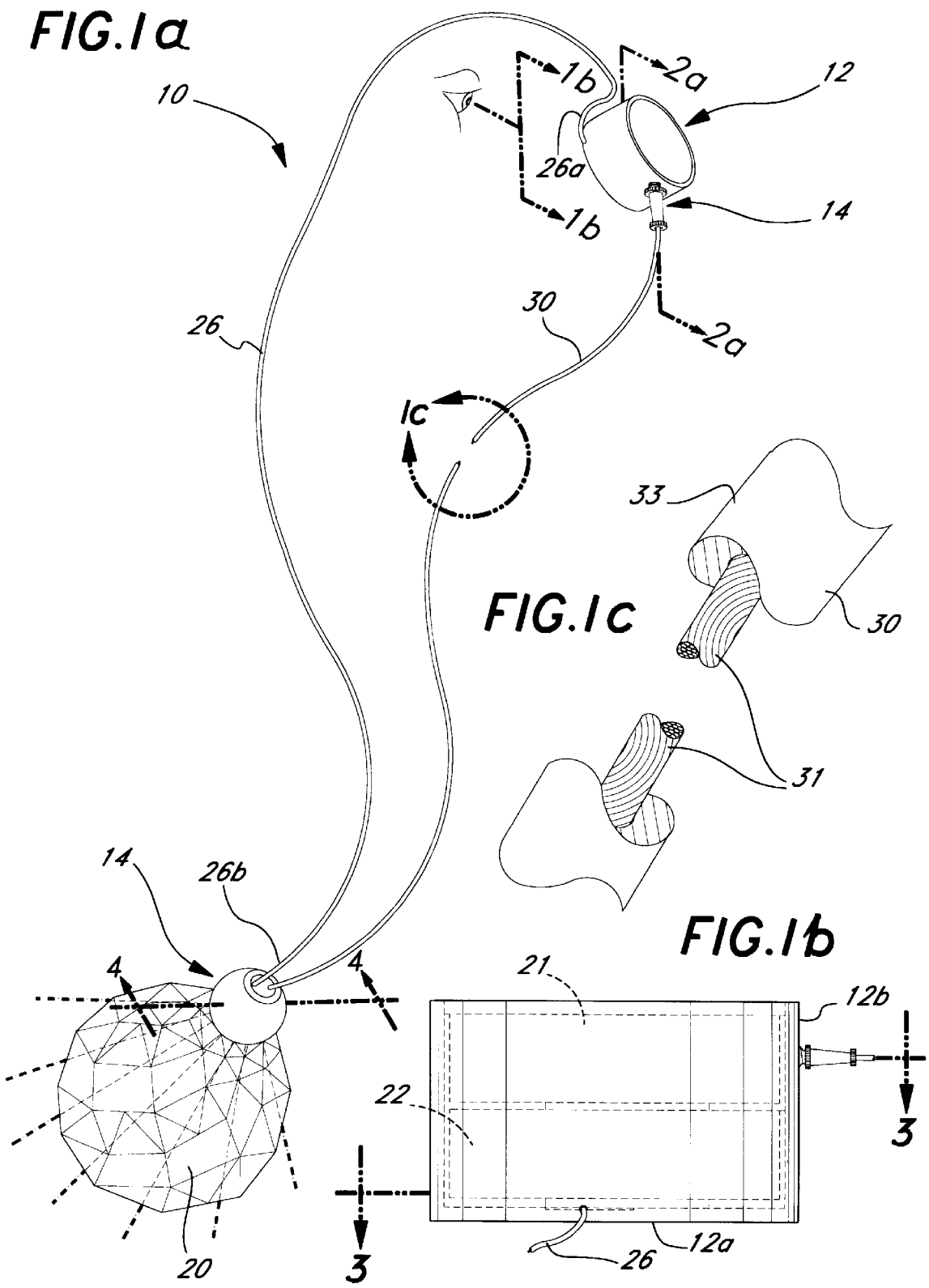
FIG. 1*a* is a perspective view of the first embodiment of the jewelry piece of this invention.
FIG. 1*b* is a side elevational view of the battery case for the first embodiment of the jewelry piece taken along line 1*b*—1*b* of FIG. 1.
FIG. 1*c* is an enlarged fragmentary view of a cut-a-way portion of one of the two wires connecting a battery to a light source in the first embodiment of the jewelry piece of this invention.

The first embodiment of this invention, the jewelry piece 10, includes a battery case 12, a metallic barrel clasp 14, a light emitting diode 16 (FIG. 4) as the light source, a housing 18 in which the diode is seated, and a transparent ornamental crystal 20 connected to the housing. A suitable light emitting diode 16 is made by Nichia Corporation of Japan.

Figure 1D:
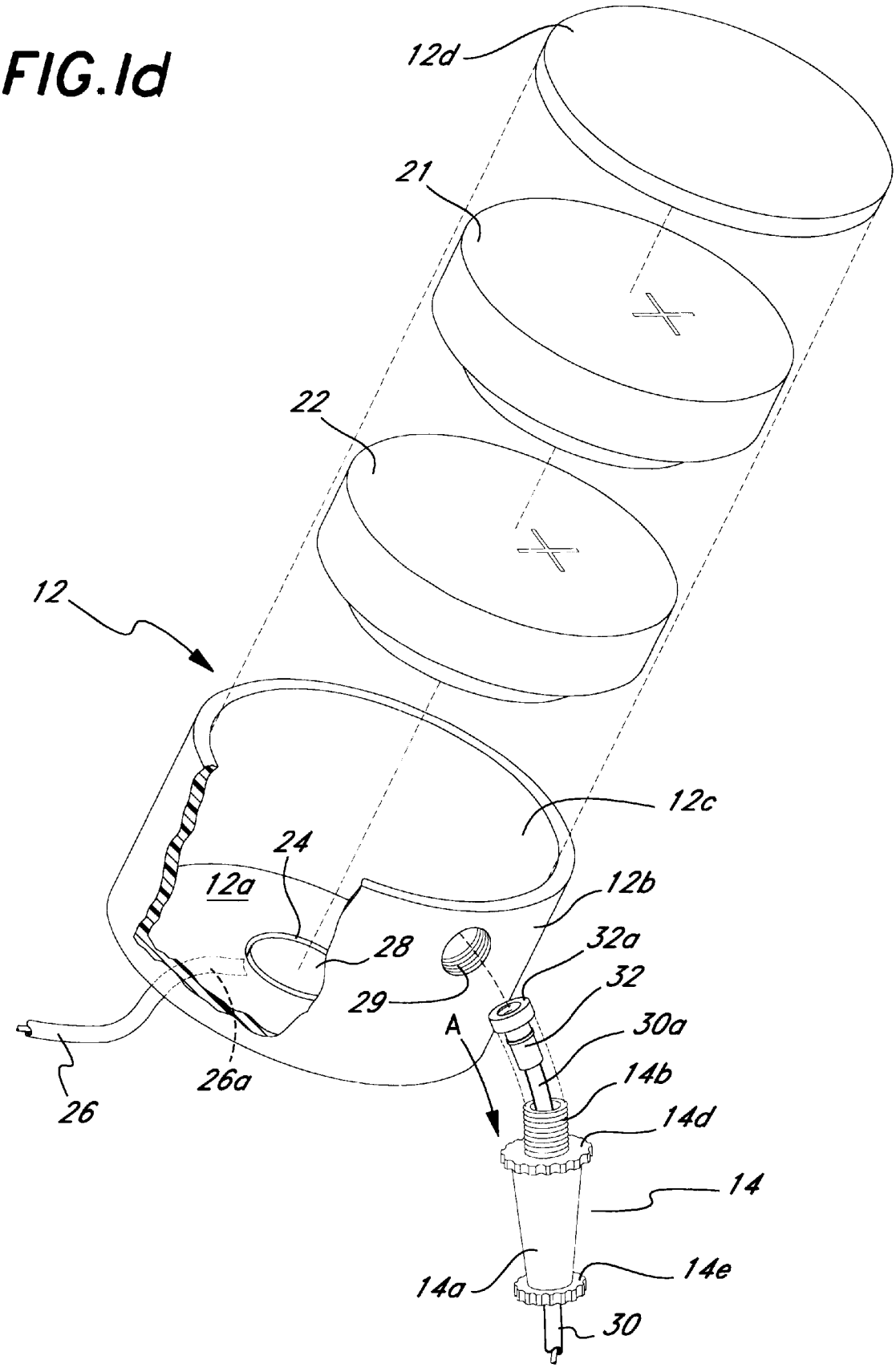
FIG. 1*d* is an exploded perspective view showing batteries being placed in the battery case.

As best shown in FIG. 1*d*, the battery case 12 is a hollow cylindrical element made from a plastic material using conventional injection molding techniques. It has a floor 12*a*, sidewall 12*b*, and an open top 12*c* in which is seated a cover 12*d* that is force fitted into the open top to snap in position to retain a pair of batteries 21 and 22 (3 volt lithium disk type) which fit snugly inside of the case 12. There is a threaded opening 29 in the sidewall 12*b*. In the floor 12*a* of the case 12 is an opening 24 through which extends one end 26*a* of a flexible wire 26. This one end 26*a* has a conductive element 28 which makes electrical contact with, in this case, the negative terminal 22*a* of the battery 22 seated in the case. This conductive element 28 may be flattened solder. The other end 26*b* of the flexible wire 26 is connected to one electrode 16*a* of the light emitting diode 16. A second wire 30 is connected to the other electrode 16*b* of the light emitting diode 16. Both the wires 26 and 30 are flexible and comprises strands 31 of conductive material such as copper covered with an insulating sheath 33, as depicted in FIG. 1*c*.

As best shown in FIG. 1*d*, and FIGS. 2*a* through 2*c*, the clasp 14 has a tubular type body 14*a* with a threaded extension 14*b* projecting outward from one end of the clasp which is inserted into the opening 29 in the sidewall 12*b* of the case 12 when attaching the jewelry piece 10 around, for example, the neck of a wearer. Thus, by inserting the threaded extension 14*b* into the opening 29 in the sidewall 12*b* and rotating in a clockwise as viewed in FIG. 1*a*, the jewelry piece 10 is attached to, for example, a wearer's neck. The tubular body 14*a* provides an elongated passageway 14*c* which extends through the entire body, including the threaded extension 14*b*.There are a pair of spaced apart, raised, knurled rings 14*d* and 14*e* on the exterior of the body 14*a* which assist in rotating the clasp 14 when attaching and detaching it around the wearer's neck.

Figure 2A:
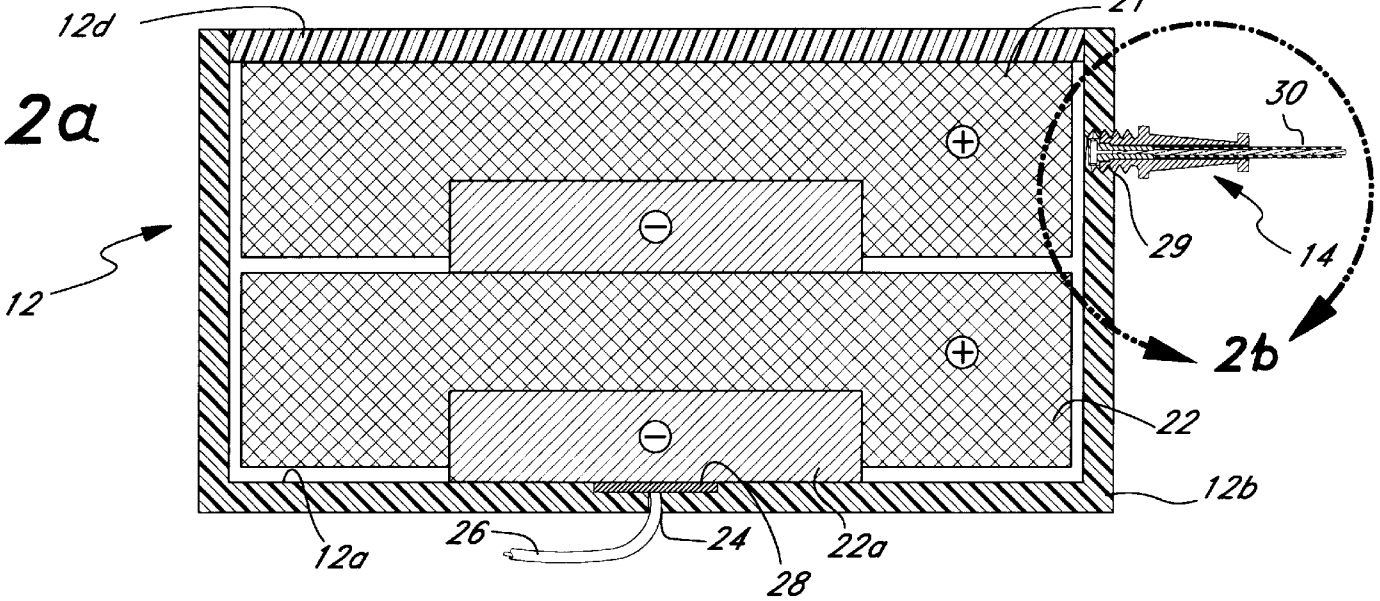
FIG. 2*a* is a cross-sectional view of the battery case taken along line 2*a*—2*a* of FIG. 1*a*.
Figure 2B:
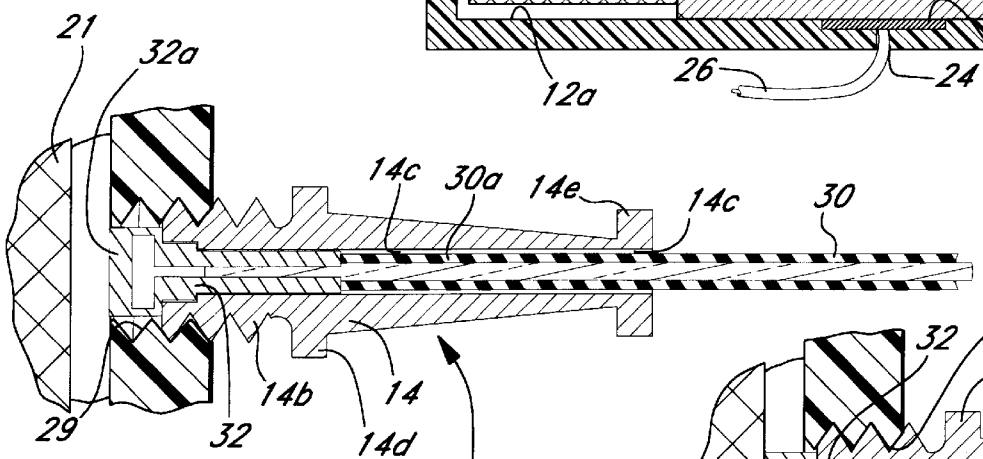
FIG. 2*b* is an enlarged, cross-sectional view of the battery case taken along line 2*b* of FIG. 2*a* with the case holding a pair of batteries and the clasp of the first embodiment of the jewelry piece partially connected so that the jewelry piece is attached and worn, for example, around the neck of the user, but not engaging a battery so that there is no illumination.
Figure 2C:
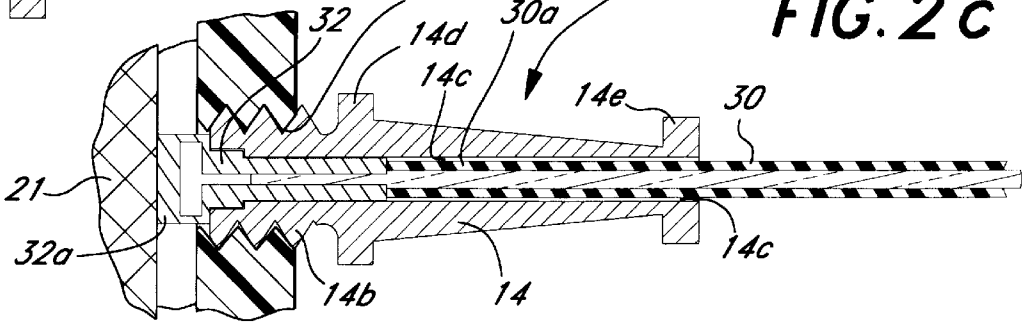
FIG. 2*c* is an enlarged, cross-sectional view similar to that shown in FIG. 2*b* with the clasp rotated to a position where a pin engages one of the batteries in the case to energize a circuit illuminating the first embodiment of the jewelry piece.

The wire 30 extends lengthwise through the passageway 14*c* and it has at one end 30*a* a conductive collet pin 32, with an enlarged head 32*a*, securely fixed to this end of the wire 30. The other end 30*b* of the wire 30, as mentioned above, is connected to the other electrode 16*b* of the light emitting diode 16. Because of the enlarged head 32*a*, which acts as a stop, the wire 30 can not be pulled through the passageway 14*c* when move in the direction indicated by the arrow A in FIG. 1*d*. The clasp 14 is, however, free to rotate about the wire 30, allowing the threaded extension 14*b* of the clasp to be inserted into the threaded opening 29 in the sidewall 12*b* of the battery case 12 and rotated. When the threaded extension 14*b* of the clasp 14 has been only partially threaded into the opening 29 as depicted in FIG. 2*b*, the head 32*a* of the pin 32 is only partially extending into the opening and does not make contact with the positive terminal of the battery 21 inside the case 12. Consequently, the wearer may attach the jewelry piece 10, for example about his or her neck, but the ornamental crystal 20 will not be illuminated. It will only be illuminated when the clasp 14 has been completely rotated to bring the head 32*a* of the pin 32 into engagement with the positive terminal of the battery 21 as depicted in FIG. 2*c* to complete a circuit to energize the light emitting diode 16, causing it to emit light.

Figures 3, 4:
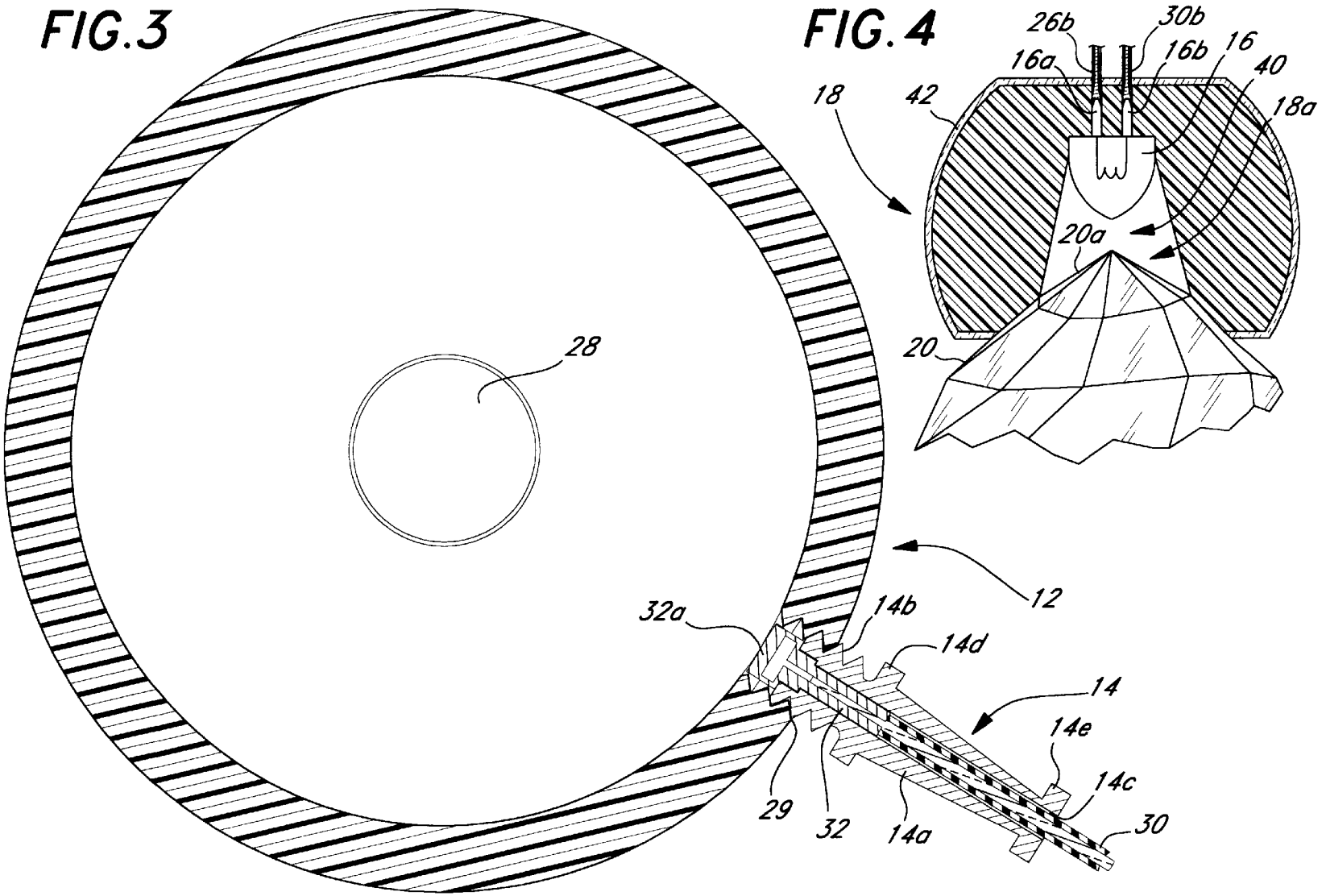
FIG. 3 is a cross sectional view of the battery case taken along line 3—3 of FIG. 1*b*, with the batteries removed to show the contact end of the other wire used to connect the batteries to the light source.
FIG. 4 is an enlarged fragmentary cross sectional view taken along line 4—4 of FIG. 1*a*, showing the light source seated within an opaque housing.

As best shown in FIG. 4, the light emitting diode 16 is seated within a cavity 40 within the housing 18 adjacent an open portion of the housing that serves as a light transmitting window 18*a*. The light emitting diode 16 is glued into position and the entire housing 18 is painted with an opaque material to provide an opaque coating 42 around the housing except for the light transmitting window 18*a*. The transparent ornamental crystal 20 has one end 20*a* adjacent this window 18*a* and is glued, or otherwise fastened, to the housing 18. Thus when the light emitting diode 16 is energized, light passes through the light transmitting window 18*a* to illuminate the transparent ornamental crystal 20 which appears to glow. To disconnect the jewelry piece 10, the clasp 14 is simply rotated in the opposite direction, for example, counter clockwise as viewed in FIG. 1*a* to loosen the clasp, allowing the pin 32 to be removed from the opening 29 in the battery case so that the wearer can remove the jewelry piece.

Second Embodiment

Figures 7, 8:
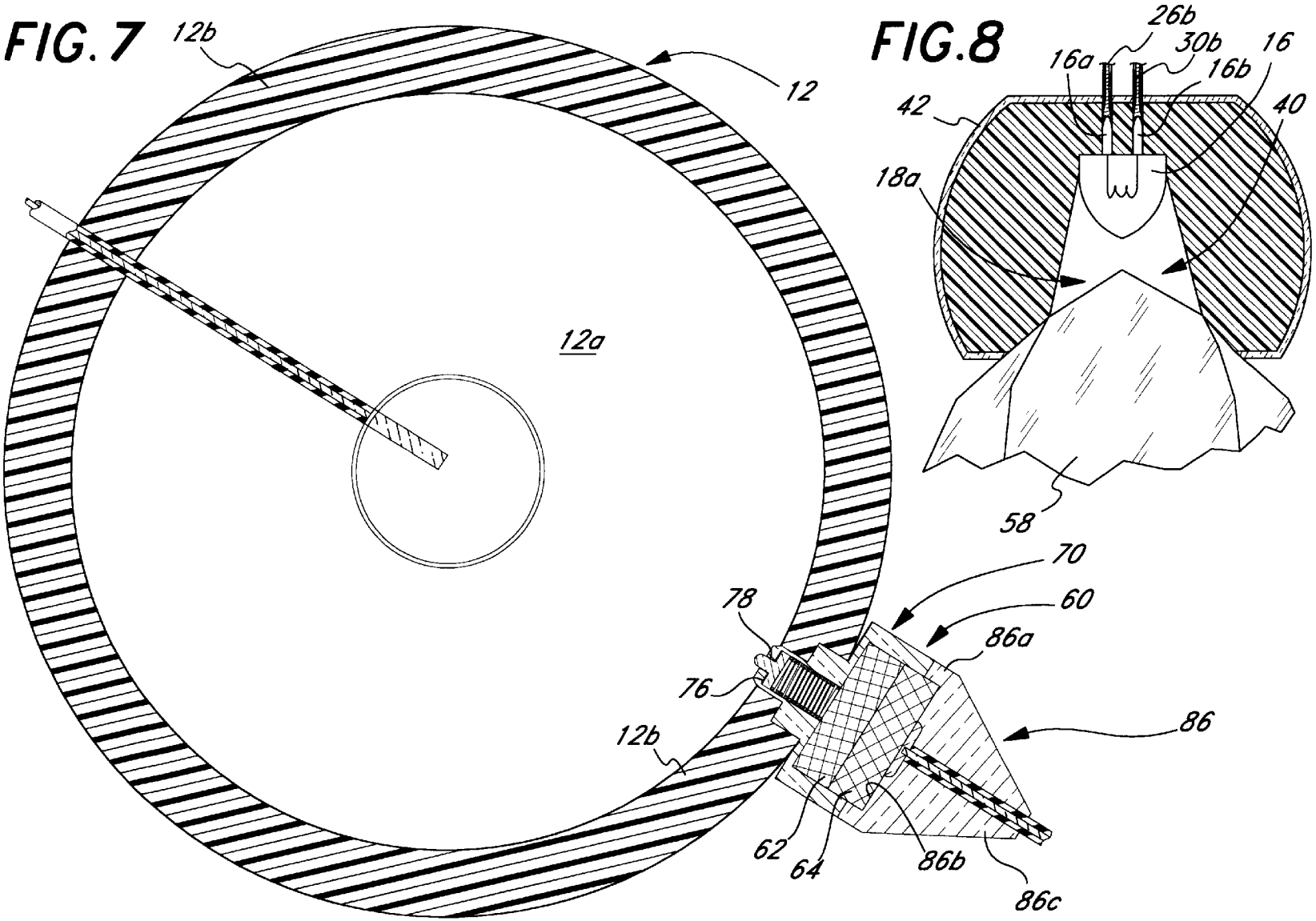
FIG. 7 is a cross-sectional view taken along line 7—7 of FIG. 7, with the batteries removed.
FIG. 8 is a cross-sectional view taken along line 8—8 of FIG. 5*a*, showing an ornamental cross seated in the housing holding a light emitting diode.

As best shown in FIGS. 5*a* through 6*b*, the second embodiment of this invention, the jewelry piece 50, includes, like the jewelry piece 10, includes a battery case 12, a light emitting diode 16 (FIG. 8) as the light source, a housing 18 in which the diode is seated. A transparent ornamental crystal cross 58 is connected to the housing 18 at its light transmitting window 18*a* (FIG. 8). The light emitting diode 16, housing 18, and battery case 12 are essentially identical to the same components of the first embodiment. The battery case 12 has a floor 12*a*, sidewall 12*b*, and an open top 12*c* (FIG. 5*c*) in which is seated a cover 12*d* that is force fitted into the open top to snap in position to retain the pair of batteries 21 and 22 which fit snugly inside of the case 12.

As in the first embodiment, in the floor 12*a* of the case 12 is an opening 24 through which extends one end 26*a* of a flexible wire 26. This one end 26*a* has a conductive element 28 which makes electrical contact with, in this case, a coiled spring 100 that contacts the negative terminal 22*a* of the battery 22 seated in the case 12. The other end 26*b* of the flexible wire 26 is connected to one electrode 16*a* of the light emitting diode 16. A second wire 30 has one end 30*b* (FIG. 8) connected to the other electrode 16*b* of the light emitting diode 16.

In accordance with this second embodiment, a magnetic clasp 60 is used for attaching and detaching the jewelry piece 50 around the body, for example, the neck, of a user. This magnetic clasp 60 comprises one magnet 62 mounted in the side wall 12*b* of the battery case 12 and another magnet 64 attached to the end 30*a* of the second wire 30. Both magnets 62 and 64 are disked shaped and are about the same diameter, typically from about ¼ to about ⅜ inch, and each magnet is about ⅛ inch thick.

Figure 9B:
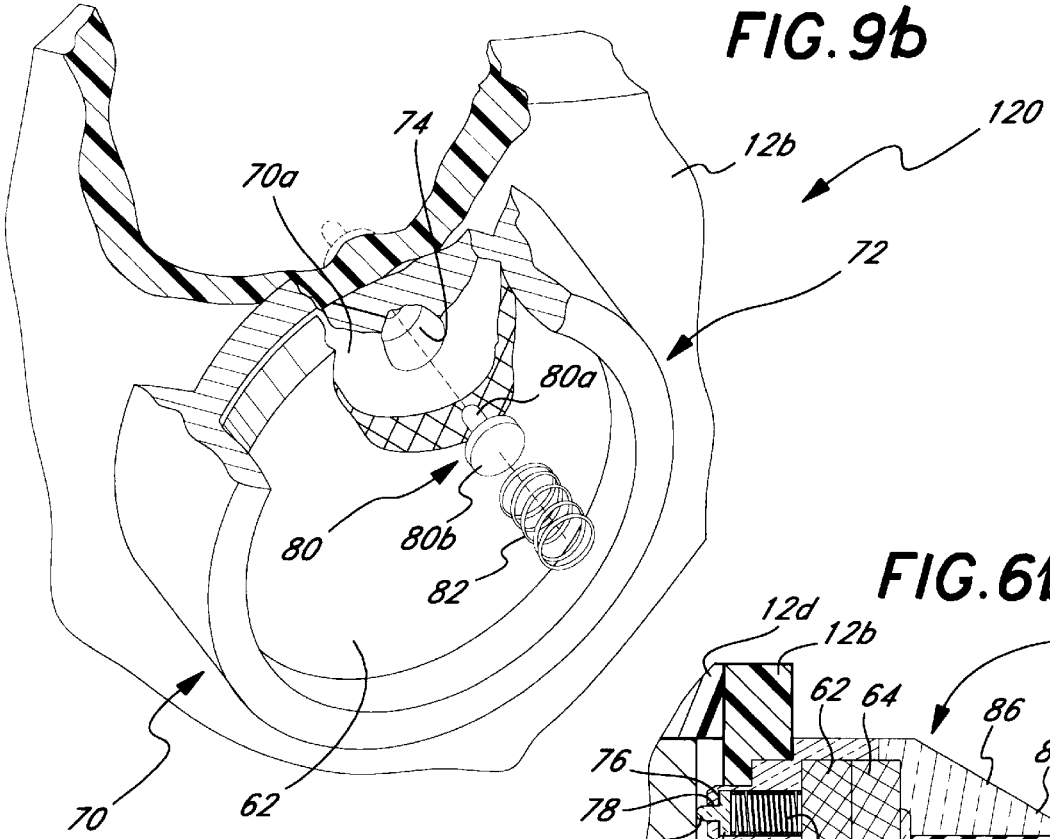
FIG. 9*b* enlarged, fragmentary perspective view taken along line 9*b* of FIG. 9*a*.
Figure 6B:
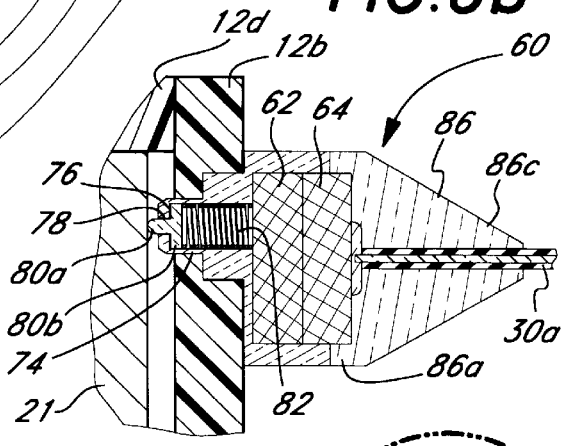
FIG. 6*b* is an enlarged fragmentary view taken along line 6*b* of FIG. 6*a*.
Figure 6A:
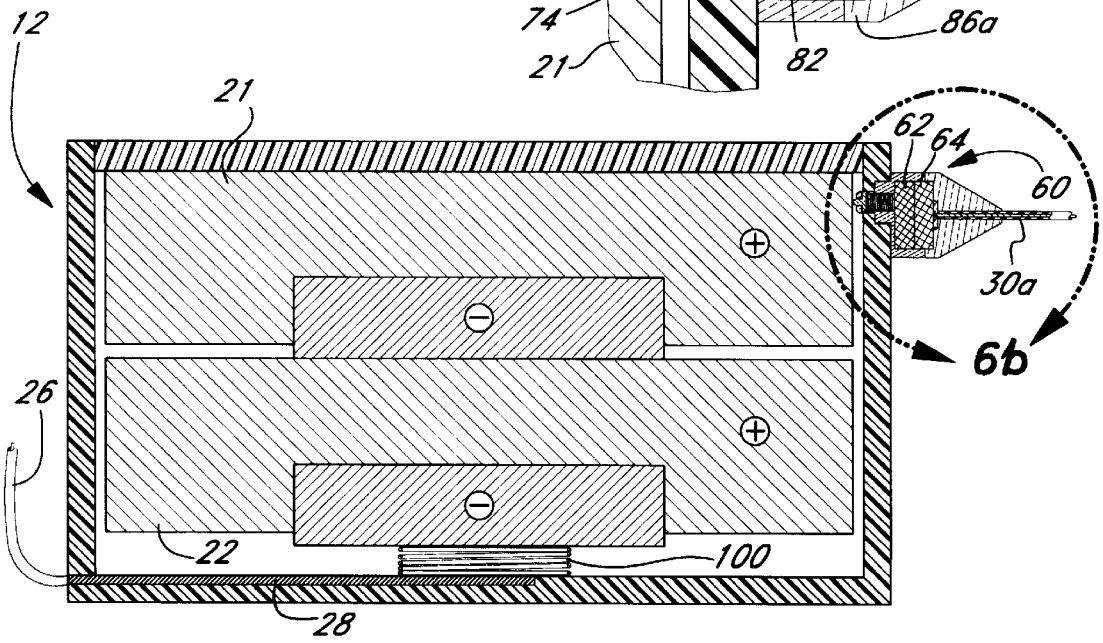
FIG. 6*a* is a cross-sectional view taken along line 6*a*—6*a* of FIG. 5*a*.

As best shown in FIGS. 6*b*, 7 and 9, the magnet 62 is seated in a recess 70 in a receptacle 72 embedded in the sidewall 12*b* of the case 12. In the bottom of the recess 70*a* is an offset bore 74 terminating in a land 76 that has an opening 78 therein. In the bore 74 is seated a tack shaped pin 80 having a pointed end 80*a* and a flat head 80*b*. A coiled spring 82 rests on the flat head 80*b* of the pin 80. One end of the spring 82 engages the magnet 62 seated and glued or other secured in the recess 70 to compress this spring so that the pointed end 80*a* of the pin 80 extends outward from the opening 78. When the batteries 21 and 22 are placed in the case 12, the one battery 21 bears against the pointed end 80*a* of the pin 80, and the spring 82 pushes this pointed end against the positive terminal of the battery 21 to insure good electrical contact.

A second receptacle 86 holds the magnet 64. This receptacle 86 has cylindrical shaped end 86*a* with a recess 86*b* therein in which the magnet 64 is seated and glued or other secured in this recess. The other end 86*c* of the receptacle 86 is tapered and it receives the end 30*a* of the wire 30. The strands 31 of conductive material of the wire 30 are soldered or otherwise in electrical contact with the inside surface of the magnet 64 seated in the recess 86*b*.

Figures 5A, 5B:
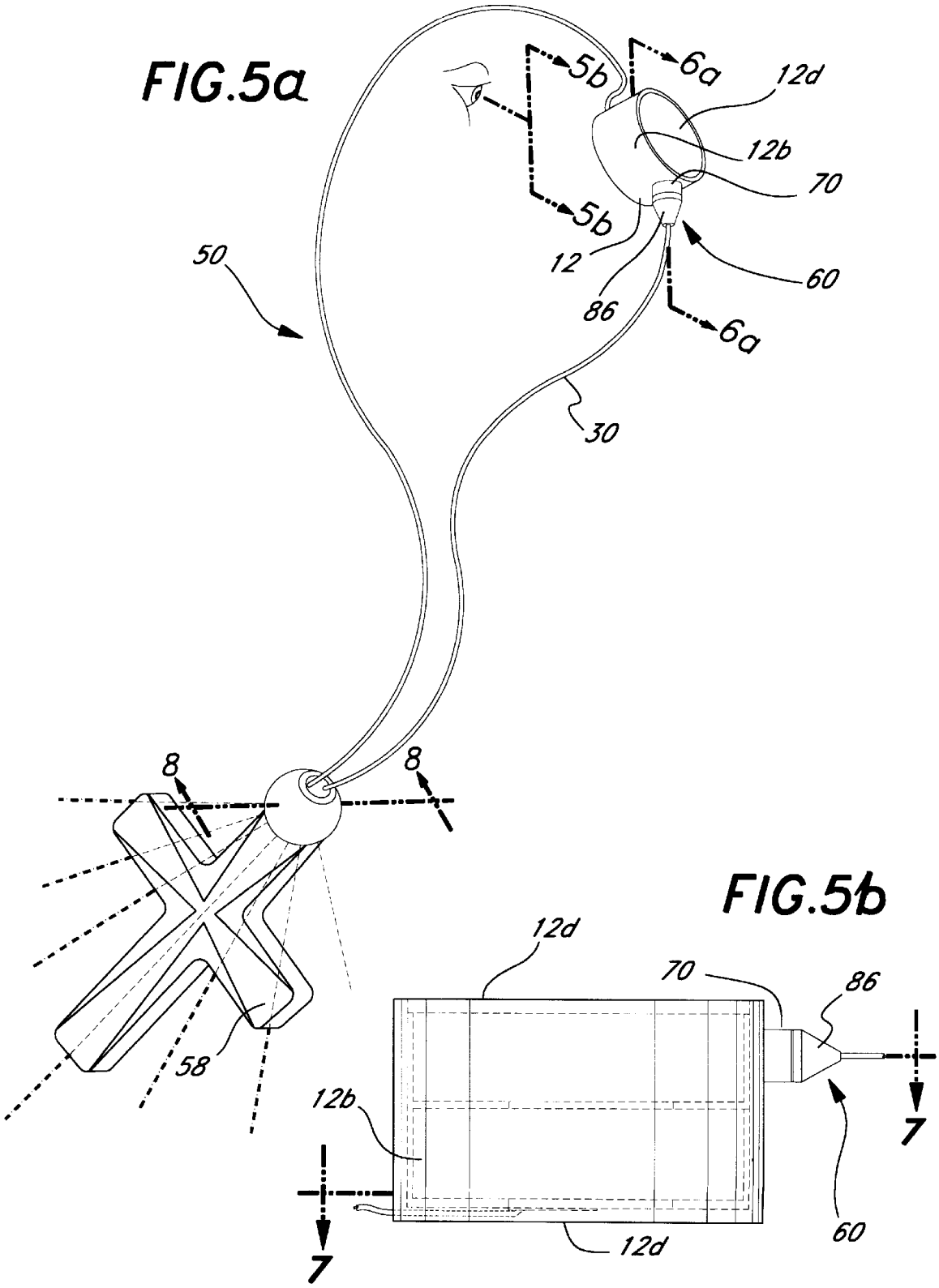
FIG. 5*a* is a perspective view of the second embodiment of the jewelry piece of this invention.
FIG. 5*b* is a side elevational view of the battery case of the second embodiment of the jewelry piece of this invention taken along line 5*b*—5*b* of FIG. 5*a*.
Figure 5C:
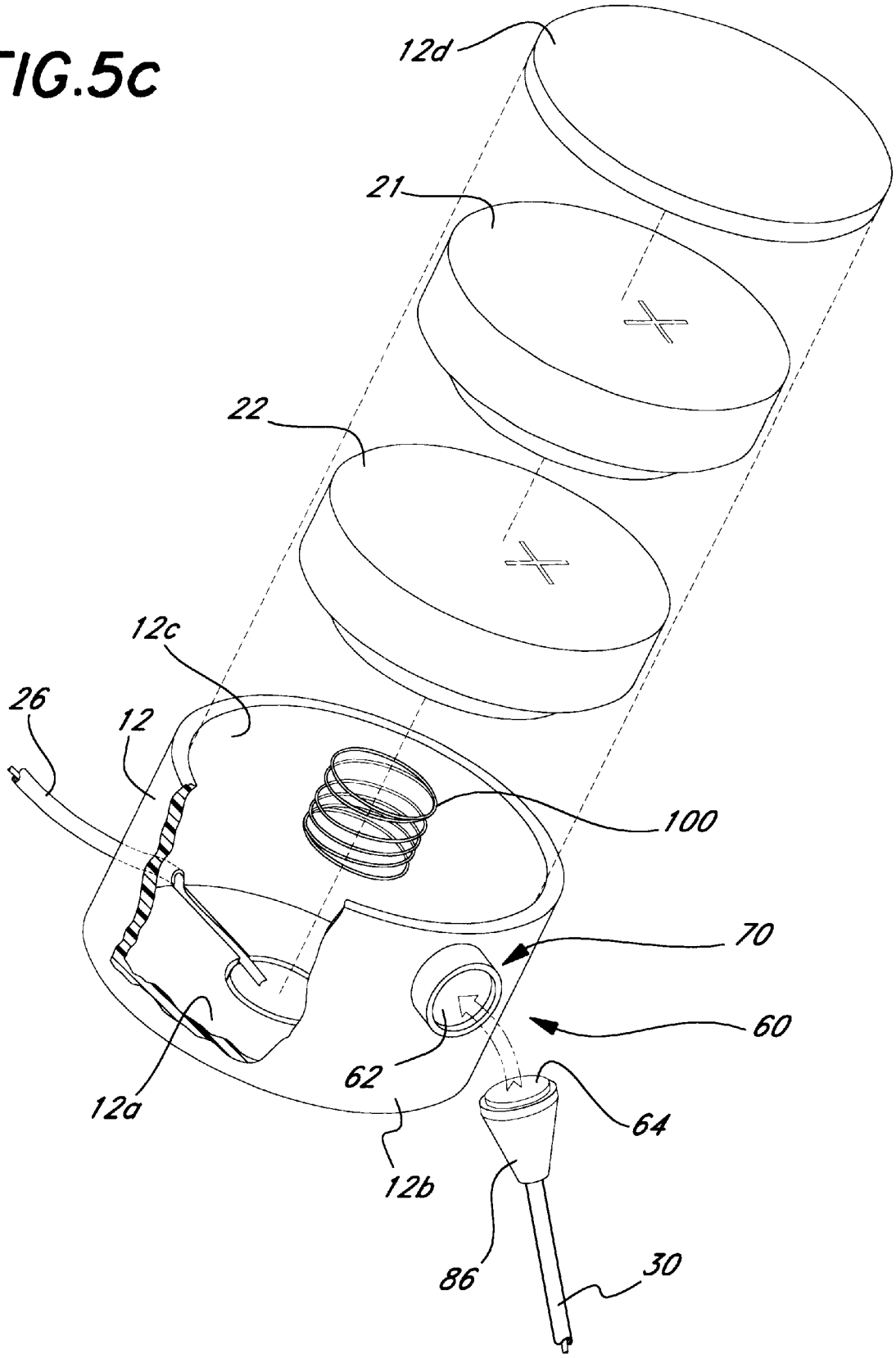
FIG. 5*c* is an exploded perspective view of the battery case of the second embodiment of the jewelry piece of this invention.

As best show in FIG. 6*b*, the one recess 70 is deeper than the thickness of the magnet 62 and the other recess 86*b* is shallower than the thickness of the magnet 64, so that upon closing the clasp 60, the receptacle 70 and magnet 64 engage in a male-female mating relationship. The outer surface of the magnet 64 engages and is flush with the outer surface of the magnet 64 when the clasp 60 is connected as shown in FIGS. 5*a* and 7 so that a circuit is completed to energize the diode 16 which illuminates the transparent ornamental crystal cross 58. When the magnets 62 and 64 are manually pulled apart, the circuit is broken and the diode 16 is deenergized, discontinuing illumination of the crystal cross 58.

Third Embodiment

Figure 9A:
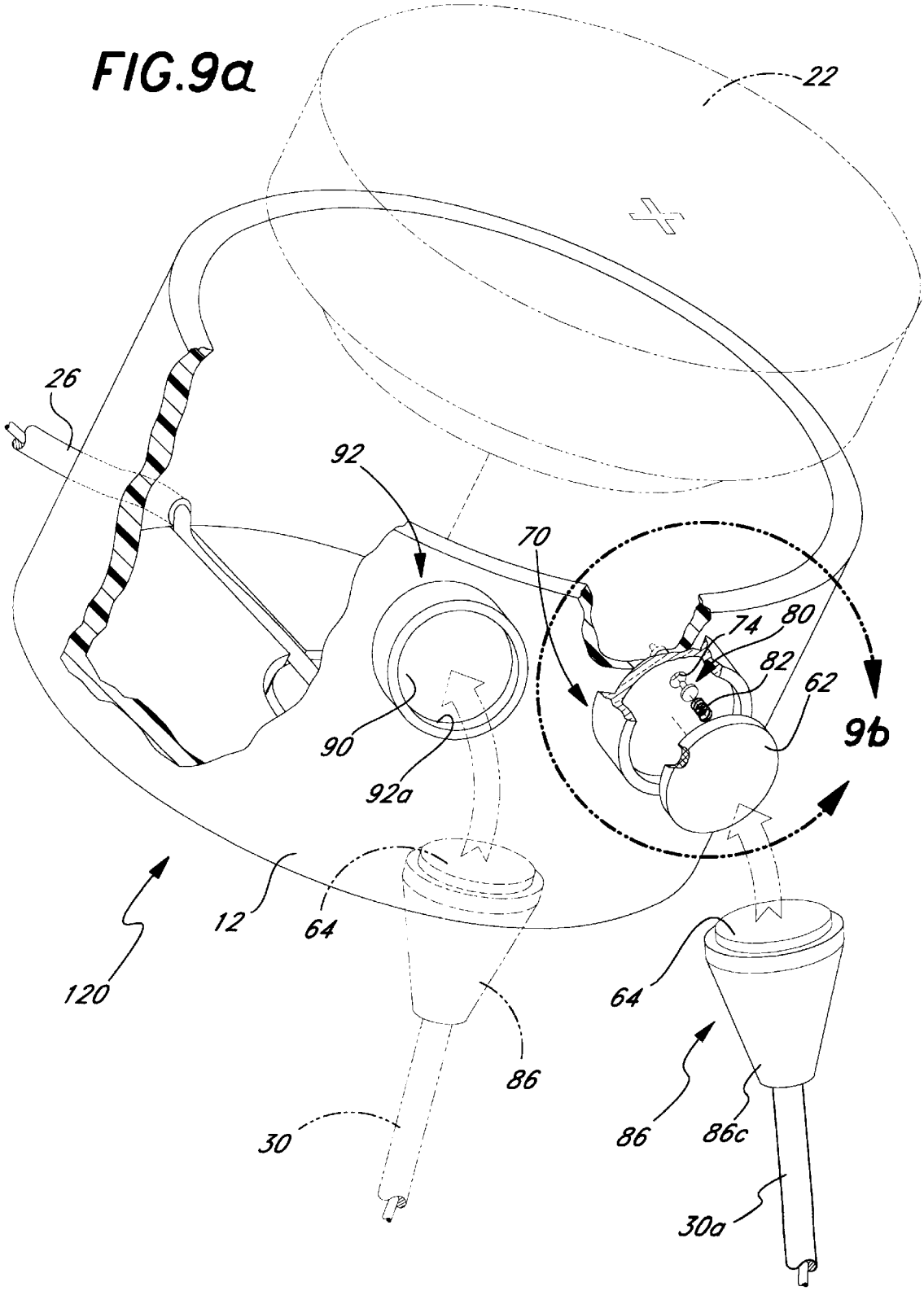
FIG. 9*a* is a perspective view of the battery case of the third embodiment of the jewelry piece of this invention.

As shown in FIGS. 9*a*, the third embodiment of this invention, the jewelry piece 120, is the similar to the second embodiment, except a third magnet 90 is mounted in a recess 92*a* in a third receptacle 92 attached to the sidewall 12*b* of the case 12. This third receptacle 92 is nearby the receptacle 70 so that it is convenient to move the magnet 64 between these two receptacles. The clasp 60 is opened by manually disconnecting the magnets 62 and 64 to allow the jewelry piece 50 to be removed from the body of the user, placing the jewelry piece in storage. If the user desires to wear the jewelry piece 60 but not have the crystal cross 58 illuminated, the magnet 64 is disconnected from the magnet 62 and moved into contact with the third magnet 90, with the jewelry piece 120 remaining on the body of the user. During storage it is also important to avoid accidentally leaving the clasp 60 connected with the magnet 62 and 64 resulting in exhausting the batteries 21 and 22.

Although the specification has described elements 62, 64 and 90 as being magnets, it is considered to be within the scope of this invention for elements 62, 64 and 90 to include either elements which are magnetized or elements which are capable of being attracted by a magnet.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

What is claimed is:

1. A jewelry piece, including a light transparent, ornamental element;

a light source having a pair of electrical contacts;

a battery case;

a battery removably positioned within the battery case;

an opaque housing having a cavity in which is seated the light source, said housing having only a single light transmitting window which allows light from the light source to be transmitted outward from said cavity; and a circuit adapted to be electrically energized by the battery placed in said battery case, said circuit comprising first and second conductive members, the first conductive member having one end connected to one of the electrical contacts and another end connected to the battery case and making electrical contact with the battery placed in said case, and the second conductive member having one end connected to the other of the electrical contacts and a free end, a magnetic clasp having first and second magnetic elements, the first magnetic element being connected to the battery case and making electrical contact with the battery placed in said case, the second magnetic element being at the free end of the second conductive member and being removably connected to the first magnetic element;

said light transparent, ornamental element being connected to the housing adjacent the light transmitting window so that, with the second magnetic element disconnected from the first magnetic element, the jewelry piece can be placed around the neck of a user; and with the second magnetic element connected to the first magnetic element, the circuit is energized and light from the light source emanates from the window and enters the ornamental element, illuminating said ornamental element;

a third magnetic element formed as part of the battery case which is electrically isolated from the battery placed in the case, enabling the second magnetic element to be connected to said third magnetic element without energizing said circuit, at least one of said first magnetic element and said second magnetic element and at least one of said second magnetic element and said third magnetic element being magnetized for magnetically coupling said second magnetic element to either said first magnetic element or said third magnetic element.

2. The jewelry piece of claim 1 where the light source is a light emitting diode.

3. The jewelry piece of claim 1 where the first magnetic element has a spring biased contact member which engages the battery placed in the battery case.

4. A jewelry piece, including a light transparent, ornamental element;

a light source mounted adjacent to the ornamental element and connected in a circuit powered by a battery having first and second terminals;

a battery case having an upper removable cover, a lower surface and a sidewall therebetween, the case removably retains said battery and has a first magnetic element formed through the sidewall of the case, the first magnetic element including a contact that makes electrical contact with the first terminal of the battery;

a first conductive connector member having one end connected to the second terminal of the battery and another end connected to the light source; and a second conductive connector member having one end connected to the light source and another end having a second magnetic element which, when placed into electrical contact with the first magnetic element, forms a loop including the ornamental element, the first and second connector members, and the battery case and completes an electrical circuit to energize the light source, at least one of said first magnetic element and said second magnetic element being magnetized for magnetically coupling said first magnetic element and said second magnetic element.

5. The jewelry piece of claim 4 including an opaque housing in which is seated the light source, said housing having only a single light transmitting window which allows light from the light source to be transmitted outward.

6. The jewelry piece of claim 4 where the light source is a light emitting diode.

7. The jewelry piece of claim 6 where the first magnetic element has a spring biased contact member which engages the battery.

8. The jewelry piece of claim 4 wherein the battery case has a third magnetic element which is electrically isolated from the battery placed in the case, enabling the second magnetic element to be connected to said third magnetic element without energizing said circuit, at least one of said second magnetic element and said third magnetic element being magnetized for magnetically coupling said second magnetic element and said third magnetic element.

9. A jewelry piece, including a light transparent, ornamental element;

a light source adjacent the ornamental element having a pair of electrical contacts;

a battery case;

a battery removably positioned within the battery case;

said battery case having a first magnetic element including a contact that makes electrical contact with a first terminal of the battery placed in the battery case and a second magnetic element which is electrically isolated from the battery placed in the battery case;

a circuit adapted to be electrically energized when the battery is placed in said battery case, said circuit comprising first and second conductive connector members, the first conductive connector member having one end to which is attached a third magnetic element to be removably connected to either the first or second magnetic elements and another end connected to one of the electrical contacts of the light source, the second conductive connector member having one end connected to the battery case in a manner which places the battery in the case into electrical contact with said one end of the second conductive connector member and another end connected to the other electrical contact of the light source;

whereby, with the third magnetic element disconnected from the first and second magnetic elements, the jewelry piece can be placed around the neck of a user; and with the third magnetic element connected to the first magnetic element, the circuit is energized and light from the light source enters the ornamental element, illuminating said ornamental element and with the third magnetic element connected to the second magnetic element, the circuit is not energized, at least one of said first magnetic element and said third magnetic element and at least one of said second magnetic element and said third magnetic element being magnetized for magnetically coupling said third magnetic element to either said first magnetic element or said second magnetic element.

10. The jewelry piece of claim 9 including an opaque housing having a cavity in which is seated the light source, said housing having only a single light transmitting window which allows light from the light source to be transmitted outward from said cavity.

11. The jewelry piece of claim 9 where the light source is a light emitting diode.

12. The jewelry piece of claim 9 where the first magnetic element has a spring biased contact member which engages the battery placed in the battery case.

13. A jewelry piece, including an ornamental element having first and second connector members extending outward therefrom, each connector member having a free end, a battery compartment formed at the free end of the second connector member, the battery compartment having a removable cover and a sidewall, a battery removably positioned within the compartment, and a clasp member for attaching the free ends together, said clasp member having a first electrically conductive magnetic member formed through the sidewall of the compartment and in electrical communication with the battery, and a second electrically conductive magnetic member secured to the free end of the first connector member, wherein the first and second connectors, ornamental element and battery selectively form an electrical circuit, wherein coupling the second magnetic member to the first magnetic member energizes the circuit, at least one of said first magnetic member and said second magnetic member being magnetized for magnetically coupling said first magnetic member and said second magnetic member.

14. The jewelry piece of claim 13 including an opaque housing having a cavity therein with an open portion serving as a light transmitting window, and a light source seated within the cavity, said opaque housing preventing light from being emitted from the housing except from the light transmitting window.

15. The device of claim 14 where the ornamental element is transparent and is seated in the light transmitting window.

* * * * *